United States Patent [19]

Fontaine

[11] Patent Number: 4,785,744

[45] Date of Patent: Nov. 22, 1988

[54] INCINERATOR OF URBAN WASTES

[76] Inventor: Claude Fontaine, Olmede-l'Honor de Cos, 82130 Lafrancaise, France

[21] Appl. No.: 50,142

[22] Filed: May 15, 1987

[30] Foreign Application Priority Data

May 15, 1986 [FR] France ..... 8607001

[51] Int. Cl.[4] ..... F23B 5/02; F23G 5/32

[52] U.S. Cl. ..... 110/214; 110/235; 110/297

[58] Field of Search ..... 110/203, 210, 211, 212, 110/213, 214, 235, 243, 244, 263, 264, 265, 286, 315, 109, 188; 431/173, 177

[56] References Cited

U.S. PATENT DOCUMENTS

| | | | |
|---|---|---|---|
| 2,070,536 | 2/1937 | Hoffman | 110/119 |
| 3,511,224 | 5/1970 | Porwancher | 126/59.5 |
| 3,566,809 | 3/1971 | Carry et al. | 110/212 X |
| 3,567,399 | 3/1971 | Altmann et al. | 110/213 X |
| 3,631,823 | 1/1972 | Scogin | 110/213 |
| 3,858,534 | 1/1975 | Barg | 110/243 X |
| 4,023,508 | 5/1977 | Cantrell, Jr. et al. | 110/243 X |
| 4,075,953 | 2/1978 | Sowards | 110/264 X |
| 4,291,634 | 9/1981 | Bergsten et al. | 110/235 |
| 4,372,226 | 2/1983 | Erlandsson | 110/235 X |
| 4,531,464 | 7/1985 | Eshleman | 110/259 |

FOREIGN PATENT DOCUMENTS

| | | |
|---|---|---|
| 1300512 | 3/1956 | Fed. Rep. of Germany . |
| 976156 | 4/1963 | Fed. Rep. of Germany . |
| 790568 | 11/1935 | France . |

*Primary Examiner*—Steven E. Warner

*Attorney, Agent, or Firm*—Lowe, Price, LeBlanc, Becker & Shur

[57] ABSTRACT

The incinerator comprises a combustion chamber (14) comprising a lower grate (40) and an outer wall (34), a device (24–32) supplying the materials to be incinerated, a primary air (44,46) blower casing (42) situated in the center of the grate, and a secondary air circuit (50,52) comprising injection nozzles (48) distributed on the periphery of the combustion chamber. Some at least of the nozzles are formed of nozzle pairs (**48*a*,48*b***) oriented according to a first angle above and under a horizontal plane and according to a second angle on either side of a vertical diametral plane.

11 Claims, 4 Drawing Sheets

X
22
18
24
26
22
25
30
27
16
28
29
32
14
22
12
20
X

X
d
73
72
74
76
78
70
18
80
86
82
84
68
81
92
16
88
91
65
90
94
66
64
X

INCINERATOR OF URBAN WASTES

FIELD OF THE INVENTION

The present invention relates to an incinerator for the disposal of urban waste, within a capacity range of 1 to 3 metric tons per hour, such that the exiting gases comprise polluting effluents in quantities lower than present installations and than the limits imposed by the most recent regulations.

BACKGROUND OF THE INVENTION

Typically, the currently used incinerators comprise a hearth in the form of a chamber provided with a floor, or lower grate, below which is located an ash box and an outer wall made of heat-resistant material. A supply device opens from the exterior into the chamber in order to introduce waste material to be incinerated as the combustion takes place.

In order to reach a combustion as complete as possible, primary air is blown from below the grate and secondary air is blown above the burning stack to ensure a complete oxidation of the combustion gases and the solid residues which are carried by such gases.

In some cases, a portion of the secondary air is blown within the burning stack from the periphery of the combustion chamber still for the purpose of reaching a more complete combustion.

However, despite all precautions, it is noted that the rate of non-burnt gaseous or solid residues remains often substantially above the limits imposed by the regulations.

SUMMARY OF THE INVENTION

An object of the invention is to educe the rate of non-burnt residues to a lower level complying with the present regulations by proposing an incinerator comprising a combustion chamber having a floor or lower grate under which is placed, an ash box and an outer wall made of heat-resistant material, said incinerator further comprising a supply device for introducing waste material into said chamber, a primary air supply circuit comprising a blower casing located substantially at the center of said grate and secondary air supply circuit comprising injection nozzles distributed along the periphery of the combustion chamber and located within at least one stage comprised within the height of the burning stack, wherein at least a portion of said nozzles is in the form of pair of nozzles which are oriented according to a first predetermined angle, one nozzle of the pair above, and the other nozzle of the pair below a horizontal plane, as well as according to a second predetermined angle on either side of a vertical diametral plane of the combustion chamber.

Therefore, owing to the invention, secondary air is blown in the form of jets directed both upwards and downwards with respect to the horizontal and directed on either side with respect to the vertical, which causes multiple turbulences in the secondary air and an excellent contact between this secondary air and the solid and gaseous components of the burning stack and hence a more complete combustion.

Complementarily, the incinerator comprises a further supply stage of secondary air which comprises injection nozzles distributed along the periphery of the combustion chamber and located within at least a stage above the height of the burning stack.

These injection nozzles may be of the single type and oriented merely radially, or else they may be constituted by nozzle pairs having the same specific orientation as aforementioned. In both cases, an excellent contact is achieved between the secondary air and the combustion gases exiting from the burning stack this resulting in an improved oxidation of these combustion gases and a complementary reduction in the rate of non-burnt components.

The invention further features a reaction chamber, located above the combustion chamber, into which the combustion gases are admitted in the form of an upwardly flowing column substantially at the center of said reaction chamber and in which the fresh reaction air is blown according to a helical downward annular flow, around the upwardly flowing column of combustion gas.

Multiple turbulences are thus created between the upwardly flowing column of combustion gas and the downward annular flow of fresh air, giving an additional oxidation of the unburnt substances present in the combustion gases and a great reduction of temperature in said combustion gases before they are rejected into the atmosphere. An added advantage to be noted is that the outer wall of the reaction chamber is cooled by the annular flow of reaction fresh air which is blown in by a corresponding blower, thus permitting the construction of said outer wall in a less expensive material, while preserving a long enough working life.

BRIEF DESCRIPTION OF THE DRAWINGS

Other details and advantages of the invention will emerge from the following description, reference being made to the accompanying drawings in which.

DETAILED DESCRIPTION OF THE INVENTION

Figure 1:
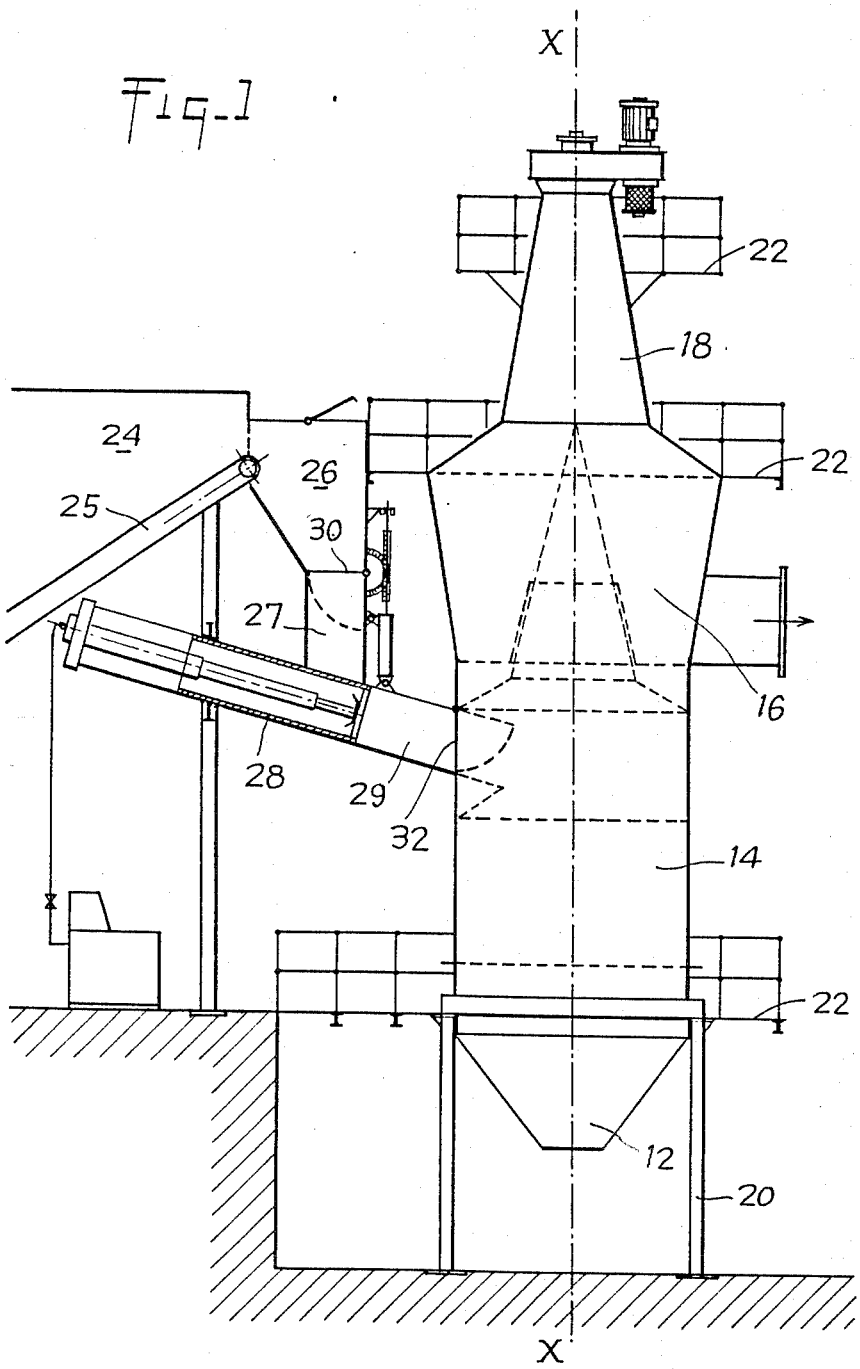
FIG. 1 is a side view of an incinerator according to the present invention.

The incinerator, illustrated as a whole in FIG. 1 has a general cylindro-conical shape of vertical axis XX and is successively composed, from the bottom upwards:

of a hopper 12 for receiving the ashes,
of a combustion chamber 14
of an oxidizing chamber 16, and
of a reaction chamber 18.

The structure and operation of each of these components will be explained in detail hereinafter. It will be noted at this point that this staged construction of the incinerator is in fact a modular assembly which can be constructed section by section. This is a considerable advantage for maintenance and possible repairs.

The incinerator assembly is supported by a frame 20 so as to be raised from the ground and to leave sufficient space between the ground and the lower opening of the ashes receiving hopper. The frame is also provided to support a certain number of platforms 22 giving access to the various levels of the incinerator.

Next to the incinerator are provided a storage hopper 24, a loading hopper 26 and a supply member 28.

The wastes to be incinerated are received in the storage hopper 24 where a conveyor 25 takes them up to the loading hopper 26.

At the bottom of the latter is connected a vertical channel 27 controlled by a motor-driven hatch 30 which issues into a supply channel 29 in which the supply member 28 moves.

Said supply channel 29 issues into the upper part of the combustion chamber where it is closed off by a pivoting loading door 32.

Figure 2:
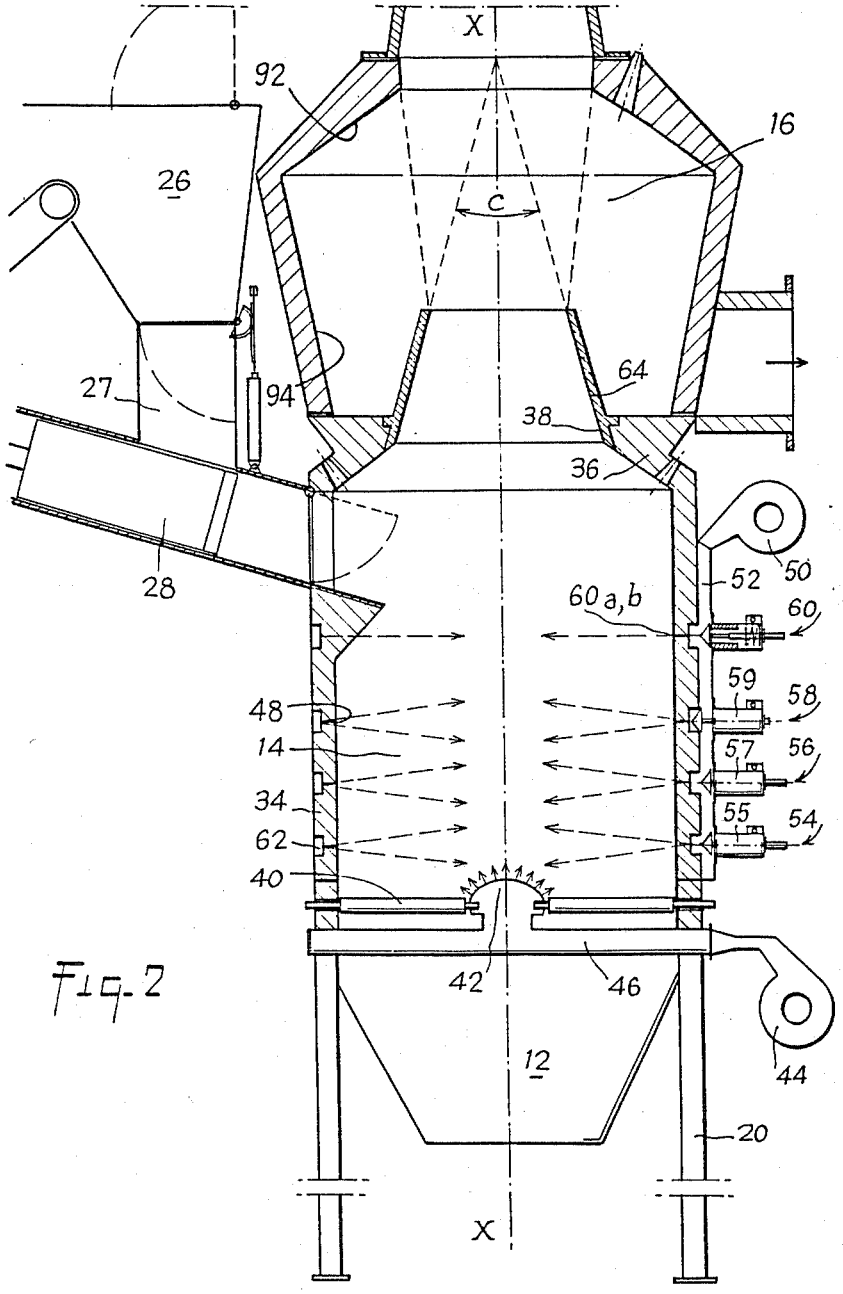
FIG. 2 is a cross-sectional view on an enlarged scale of the lower part, or combustion chamber, of the incinerator according to FIG. 1.

Referring now to FIG. 2, this shows that the combustion chamber 14 comprises a cylindrical wall 34 in heat-resistant material, and an upper vault 36 providing a central opening 38 for the passage of the combustion gases towards the transfer chamber 16, as will be explained hereinafter.

At the base of the combustion chamber, a hearth grate 40 receives the combustion materials introduced by the feeding member 28. Said grate is preferably formed by oscillating bars so as to allow the discharge of ashes and slags towards the ashes-receiving hopper. For simplification purposes, the bars-oscillating mechanism has been omitted from the drawing.

At the center of the hearth grate, there is provided a primary air blower casing 42 which is supplied by means of a primary blower 44 via a conduit 46 going through the upper part of the ashes-receiving hopper, and which diffuses the primary air through the combustion material substantially in the center of the chamber and in the manner of a sprinkling rose, i.e. in all directions and as evenly as possible. Preferably, conduit 46 will be produced with one of the hollow rectangular sections forming part of the supporting structure of the incinerator assembly.

Above the level of the grate and at various different stages, there are provided secondary air injecting nozzles 45 supplied by a secondary blower 50 via a conduit 52 applied against the outer wall of the combustion chamber, and distributing air to annular collectors 62 supplying the aforesaid nozzles.

In the illustrated example, there are four secondary air blowing stages, i.e. from the bottom to the top, three stages 54, 56 and 58 for blowing in secondary air into the material in combustion, which stages are worked according to the height of the latter, and a stage 60 for blowing in secondary air above the burning material within the combustion gases.

Figure 4:
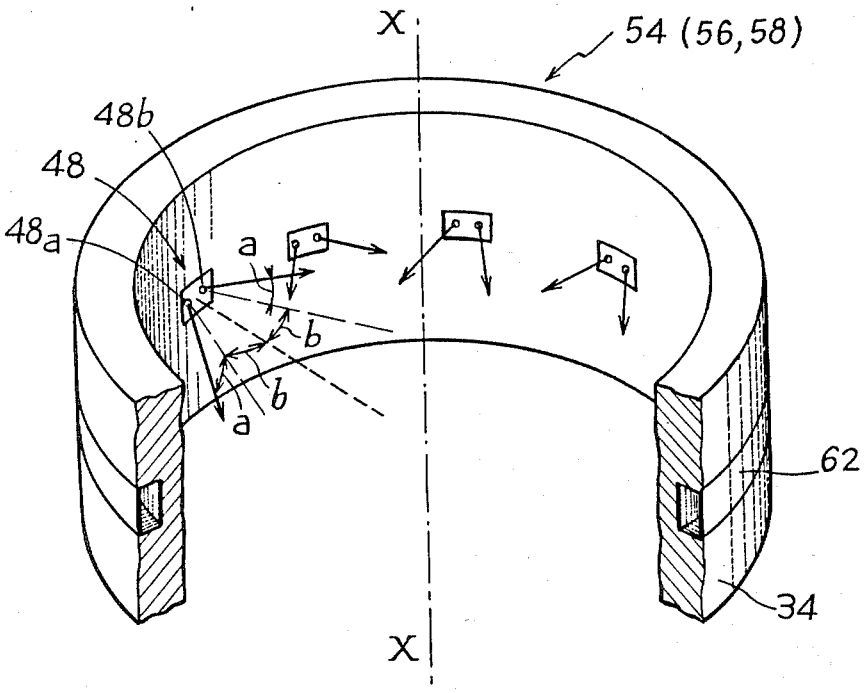
FIG. 4 is a diagrammatical perspective view of the arrangement of the injection nozzles for blowing secondary air into the combustion chamber.

As illustrated in detail in FIG. 4, each nozzles stage, at least stages 54, 56, 58 is formed of a series of nozzles distributed on the periphery of the combustion chamber, and said nozzles, or at least part of them, are formed of pairs of nozzles 48*a*, 48*b* oriented to form a preset angle a with the horizontal plane, one of the nozzles 48*a* being oriented above said horizontal plane, and the other nozzle 48*b* being oriented under said horizontal plane. Moreover, the nozzles are oriented so as to form a second preset angle b on either side of the vertical diametral plane traversing the nozzle, namely that one of the nozzles is oriented according to an angle b on one side of said diametral plane, and the other nozzle is oriented according to an angle b on the other side.

As a variant, only one nozzle out of two is formed by a pair of nozzles, as indicated hereinabove, the other nozzles being directed radially only.

The multiple secondary air jets, thus blown into the combustion material cause, because of their particular orientation, a maximum penetration of secondary air inside the burning material, hence a combustion as complete as possible while reducing to a minimum the rate of unburnt substances in the combustion gases which raises above the burning stack.

The height of said stack is detected by means of a detector, and a control device processes the information in order to bring into service the various secondary air blowing stages, successively as a function of that height, by means of valves 55, 57, 59 (FIG. 1).

The fourth secondary air blowing stage is also composed of a series of nozzles distributed on the periphery of the combustion chamber, which nozzles are also formed of pairs of nozzles 60*a*, 60*b*.

Said nozzles can, as the previous ones, have the same characteristic orientations, namely:

an angle a above or under the horizontal plane, an angle b on one side or another of the vertical diametral plane, so as to cause multiple turbulences and an intensive stirring of the second air thus blown in with the combustion gases, which completes the combustion of the unburnt substances present in these gases.

As a variant, said pairs of nozzles can be directed in the horizontal plane (angle a being equal to zero) and oriented according to an angle b on either side of the diametral plane, thus producing a screen of secondary air above the burning stack. The effect of that screen is to make an efficient barrier against the movement of solid particles.

According to another variant, only nozzles 60 are provided said nozzles being directed radially only.

Preferably, according to the invention, angles a and b are equal to or less than 15 degrees.

Conduits 62 (FIGS. 2 and 4) each one supplying stages of nozzles form rings around the combustion chamber, said rings being situated in the thickness of the heat-resistant material constituting the wall. This enables a cooling of the wall owing to the secondary air flow and a cooling of said secondary air before this is blown into the combustion chamber.

At the top of the combustion chamber, the outlet 38 for the combustion gases is surrounded by a concentrating collar 64 of truncated shape, of which the top angle a is such that the top is situated on the axis XX substantially at the basis of the reaction chamber, to be described hereinafter in detail.

Due to said collar 64, the combustion gases are regrouped or concentrated in the form of an upwardly flowing column 66 which traverses the transfer and discharge chamber 16, carrying at its periphery a small quantity of gases flowing on the periphery of the said chamber, hence causing the recycling of said gases in the reaction chamber.

Said reaction chamber 18 (FIG. 3) is also truncated-shaped with a top angle d of between 14 and 24 degrees (FIG. 3), preferably between 15 and 18 degrees.

The large base, situated at the lower end 68 corresponds to the top of the transfer and discharge chamber 16, and the small base, situated at the upper end 70, is topped by a reaction air admission circuit 72.

The reaction air admission circuit is composed of a blower 74 and of an admission ring 76 of annular shape, equipped on the inside with a series of inclined blade 78, so that the reaction air is introduced in the form of an annular upward flow "sticking" to the outer wall 80 of the reaction chamber and imparted with a helical and centrifugal movement, the effect of which is to cool the lower wall 70 of the reaction chamber, and moreover to create a depression inside the axial zone which sucks in, at the largest base of the cone, part of the air blown in, and the column of gases and fumes issued from the combustion chamber.

Numerous turbulences 86 are created between these two currents, these turbulences ensuring a thorough stirring thereof and a complementary oxidation of any unburnt substances which may be present in the combustion gases, as well as a great reduction of the temperature of the latter. By way of illustration, the temperature of the combustion gases at the outlet from the combustion chamber is between 900° and 950° C. and the temperature at the outlet from the combustion chamber, i.e. in the annular zone around the periphery of the base thereof, is between 750° and 800° C.

To control the reaction fresh air blowing speed, the admission circuit 72 is provided with a control plunger 73, in the form of a cylinder closed at its lower end and which can be more or less lowered into the admission ring.

At the base of the reaction chamber 18, the wall 80 comprises a short section 81 which is approximately cylindrical, so that the flow issued from the reaction air/combustion gas mixture is slightly deviated vertically in the direction of the combustion gas upwardly flowing column so as, first to confine the latter in the central zone of the oxidizing chamber 16, and second to create in said zone certain turbulences of mixture and an oxidation of the combustion gases of the column.

The mixture outletted from the reaction chamber 18 goes through the oxidizing chamber 16 in the annular zone 88 surrounding the column of combustion gas 66. This mixture flows according to a rotary movement in the same direction as the helical movement of reaction air, then escapes through a tangential orifice 90 wherefrom it is sucked in through an extraction and rejection blower, not shown for simplification purposes.

Figure 3:
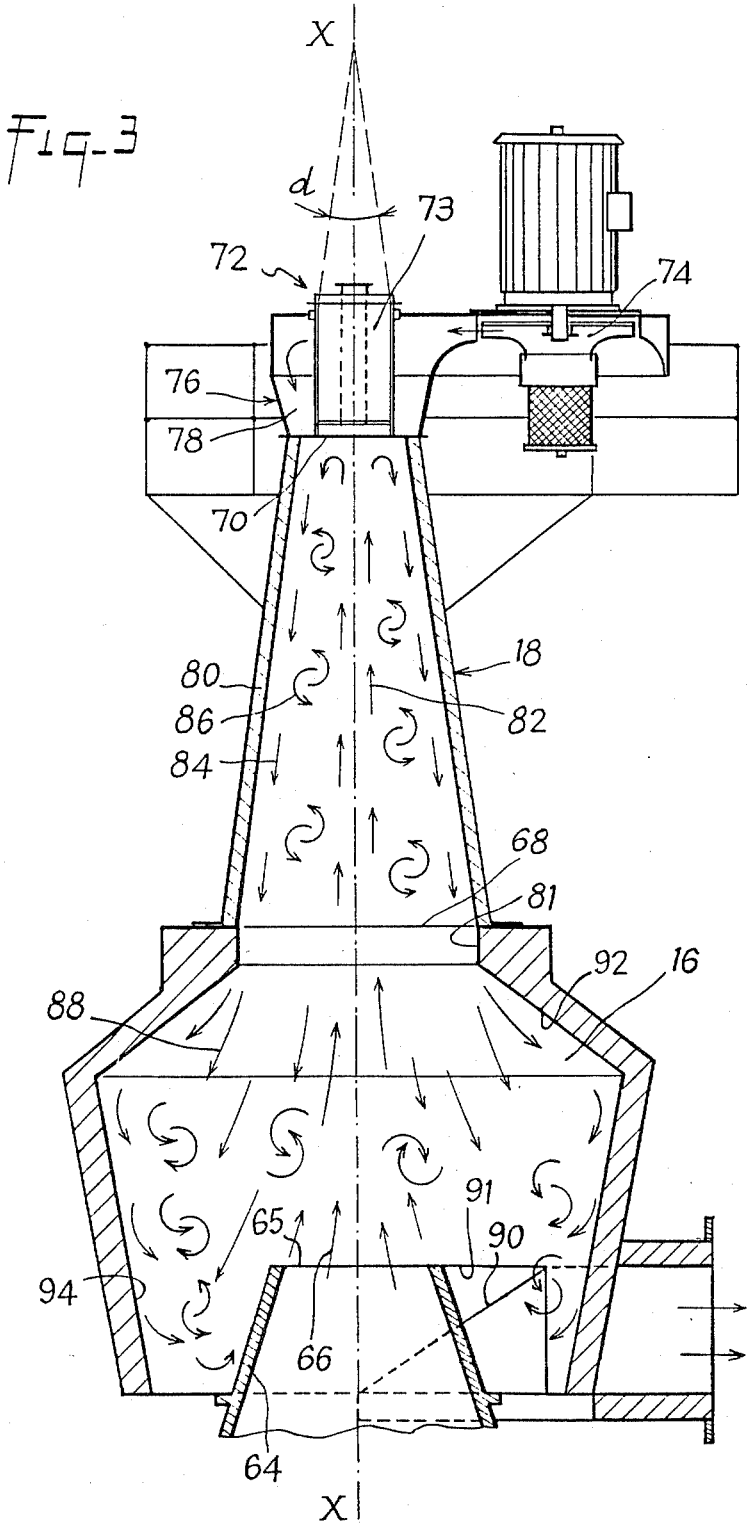
FIG. 3 is a cross-sectional view on an enlarged scale of the upper part, or reaction chamber, of the incinerator according to FIG. 1.

The oxidizing chamber is bi-conical shaped, i.e. with an upper truncated portion 92 which opens out downwardly from the large base of the reaction chamber, and a lower truncated portion 94 which narrows downwardly to a zone surrounding the concentrating collar 64 at the top of the combustion chamber. Advantageously, as illustrated in FIG. 3, the upper edge 65 of concentrating collar 64 and the upper edge 91 of the tangential orifice 90 will be placed approximately at the same level.

This therefore determines in the annular zone 88 a flow of the mixture of reaction air and combustion gas which is, first, divergent with expansion of the mixture and formation of turbulences which increase the dwelling and reaction time, and a slightly convergent flow by reflection onto the lower truncated part, this involving an interface contact with the upwardly flowing column issued from the combustion chamber.

Moreover, close to the lower part of the oxidizing chamber, the mixture which is reflected onto the lower truncated part is again deviated onto the external surface of the flange, this further increasing the mixing of the gaseous mixture before its final discharge through orifice 90.

The materials used for the various parts of the incinerator are, by way of example, as follows:

| | |
|---|---|
| (a) primary air diffuser | heat-resisting steel |
| (b) hearth grates | heat-resisting iron |
| (c) wall of the combustion chamber (inwardly from the outside) | shell in sheet steel "CORTEN" ceramic fibers insulator, refractory concrete |
| (d) concentrating sleeve | heat-resisting ceramic |
| (e) feeding door | refractory casting |
| (f) wall of transfer | as for combustion chamber |
| (g) wall of reaction | outer shell in steel plate "CORTEN" lining in refractory concrete |
| or as a variant: | outer shell in steel plate "CORTEN" inner shell in heat-resisting steel with intermediate air flow. |

All the necessary mechanisms and detectors will of course be provided for operating and controlling the incinerator, as well as all the prescribed safety sampling installations.

The incinerator can be optionally operated by hand or automatically. The automatic control means can be restricted to a continuous operation, the starting and extinguishing phases being controlled by hand.

The following important points will be noted, whether the incinerator is operated by hand or automatically:

(a) operation of the feeding member will be so determined as to keep constant the height of the burning stack inside the combustion chamber;

(b) the number of secondary air blowing stages set in operation corresponds to the height of the burning stack;

(c) the secondary blower speed drive is controlled as a function of the temperature of the combustion gases, in order to keep said temperature within a range of 900° to 950° C. and to avoid melting of any glass or slag contained in the burning stack;

(d) the speed drive of the reaction air admission blower is controlled as a function of the temperature of the gases inside the oxidizing chamber in order to keep the latter within a range of 750° to 800° C. and to promote pyrolysis and complete combustion of the unburnt gaseous or solid substances in the combustion gases;

(e) detection of the dust content of the exhausting gases, by means of an opacimeter, enables the control of the secondary air blower towards an increase of the flowrate, and of the secondary air circuit by reducing the flowrate and putting one or two stages out of operation.

It will be noted from the foregoing description, that the incinerator can work semi-continuously, with a short interruption (about two and a half hours a day) for extracting the slags and re-igniting. The igniting requires no special device and is performed by hand with papers and cardboards, and a minimum layer of wastes. This type of incinerator is considered as self-contained and works by spontaneous combustion.

What is claimed is:

1. Incinerator comprising a combustion chamber having a floor or lower grate under which is placed an ash box and an outer wall in heat-resistant material, a supply device for introducing the materials to be incinerated, a primary air supply circuit comprising a blower casing situated substantially in the center of the grate, and a secondary air supply circuit comprising injection nozzle means distributed around the periphery of said combustion chamber and located within at least one stage within the height of the burning stack, at least part of said nozzle means comprising a plurality of mutually spaced nozzle pairs each nozzle pair being oriented according to a first predetermined angle (a), one above and one under a horizontal plane, as well as according to a second predetermined angle (b) on either side of a vertical diametral plane of the combustion chamber with adjacent nozzles in each pair being oriented in opposite directions relative to the horizontal plane and the vertical diametral plane.

2. The incinerator of claim 1, wherein said incinerator comprises at least two stages of secondary air injection nozzles, situated within the height of the burning stack and valves controlling the blowing of secondary air by said stages as a function of the height of said burning stack.

3. The incinerator of claim 1, wherein said incinerator further comprises a stage of secondary air blowing nozzles situated above the burning stack.

4. The incinerator of claim 1, wherein said predetermined angles (a) and (b) are between 0 and 15 degrees.

5. The incinerator of claim 1, wherein said incinerator comprises a reaction chamber, placed above the combustion chamber, in which the combustion gases are admitted according to an upwardly flowing column substantially in the center of said reaction chamber and into which fresh reaction air is blown, according to a downward helical annular flow around the upwardly flowing column of combustion gas.

6. The incinerator of claim 5, wherein the combustion chamber comprises at its upper part a concentrating collar of truncated shape of which the top angle (c) is such that the top is situated substantially at the base of said reaction chamber.

7. The incinerator of claim 5, wherein said incinerator comprises an oxidizing chamber situated between the combustion chamber and the reaction chamber and traversed in its center by the upwardly flowing column of combustion gases from the combustion chamber towards the reaction chamber, and on its periphery by the downward annular flow of reaction air, mixed with the combustion gases exiting from the reaction chamber.

8. The incinerator of claim 7, wherein the oxidizing chamber is formed of an upper truncated portion which opens out downwardly from the base of the reaction chamber, and of a lower truncated portion narrowing towards the top of the combustion chamber and in which a tangential outlet is provided.

9. The incinerator of claim 5, wherein the reaction chamber comprises a truncated external wall of which the large base is situated at the lower end, and having a predetermined top angle (d) between 14 and 24 degrees.

10. The incinerator of claim 9, wherein said incinerator comprises a reaction air admission circuit, situated at the upper end of said reaction chamber, composed of a blower and of an annular-shaped admission ring topping said reaction chamber.

11. The incinerator of claim 10, wherein said admission ring is equipped with a series of inclined blades, so that the downward annular flow of reaction air is imparted with a helical movement.

* * * * *